US006151728A

United States Patent [19]

Wright et al.

[11] Patent Number: 6,151,728

[45] Date of Patent: Nov. 28, 2000

[54] COMBINATION SHOWER HEAD AND SCRUB BRUSH

[75] Inventors: David Wright, San Rafael; Kenneth Tallow, Corte Madera, both of Calif.

[73] Assignee: Equity Masters, Inc., San Rafael, Calif.

[21] Appl. No.: 09/415,750

[22] Filed: Oct. 12, 1999

[51] Int. Cl.[7] ..... A47K 7/02

[52] U.S. Cl. ..... 4/606

[58] Field of Search ..... 4/606; 15/22.1, 15/104.92

[56] References Cited

U.S. PATENT DOCUMENTS

| | | | |
|---|---|---|---|
| 3,875,604 | 4/1975 | Wurn et al. | 4/606 X |
| 4,151,623 | 5/1979 | Steere | 4/606 X |
| 4,155,137 | 5/1979 | Kadlub | 4/606 X |
| 5,561,869 | 10/1996 | Sarel | 4/606 |
| 5,588,160 | 12/1996 | Nichols | 4/606 |
| 5,774,907 | 7/1998 | Doggwiler | 4/606 |

*Primary Examiner*—Charles E. Phillips

[57] ABSTRACT

Combination shower head and scrub brush with a flexible hose and attachment to fasten to a standard shower spigot, a hanging bracket secured to the standard shower spigot that releasably secures the combination shower head and brush head assembly, an extendible and retractable handle shaft having a hollow interior portion to accept the flow of water, an enclosed chamber containing pair of water flow director hoses and a liquid soap holding portion, a paddle wheel located within said enclosed chamber powered by water emanating from the first said hose, a shower head integral to the outer body of said enclosed chamber connected to said second water hose, a selector valve and associated selector knob to direct water into said first hose or said second hose, a liquid soap release valve and associated push button to dispense soap into a sponge portion secured to the outer body of said enclosure, a reclosable cap located on the outer surface of said enclosed chamber for the purpose of filling said chamber with liquid soap, a replaceable and removable scrub brush mounted onto a circular plate capable of being rotated by said water driven paddle wheel, and a plurality of alternate scrub brushes for cleaning surfaces other than the human body.

1 Claim, 5 Drawing Sheets

COMBINATION SHOWER HEAD AND SCRUB BRUSH

BACKGROUND OF THE INVENTION

This invention relates generally to the field of shower heads, and more particularly to combination shower head and scrub brush.

Bathing and cleaning ones self is a necessity of human life.

Within the past one hundred years, taking a shower in an enclosed shower stall has become a popular and accepted means of cleaning ones self. In a shower enclosure a person may turn on the flow of either hot or cold water and cause the water to come out under pressure from a shower head usually located just above the head of the user. The user then applies soap to his or her body and proceeds to gently scrub the body either by hand or with the assistance of a wash cloth, cleaning brush or the like. While the standard method of washing as just described is efficatious, it tends to be time consuming and potentially inefficient in that some areas of the body are hard to reach by hand such as the upper back. Additionally, if one were to use a long handled scrub brush for cleaning ones back, the brush may be difficult to store in a shower environment and may be unsuitable to use for cleaning other areas of the body that do not require a long handle. Scrub brushes tend to have stationary bristles or the like and require the user to move his or her arm in an awkward manner to provide adequate cleaning. Furthermore, it is a common problem when using a bar of soap or even a liquid soap dispenser, that some soap may be wasted by either dropping the soap bar or, in the case of liquid soap, having the soap be prematurely diluted by the oncoming shower water. The use of a separate shower head, scrub brush and soap require more time and effort to use and are less efficient than the combination shower head and rotating scrub brush of the present invention described below.

SUMMARY OF THE INVENTION

The primary object of the invention is to provide a better shower head that incorporates an integral scrub brush.

Another object of the invention is to provide a combination shower head and scrub brush where the brush portion is rotatable using water power.

Another object of the invention is to provide a combination shower head and scrub brush that also incorporates a liquid soap reservoir and dispensing means.

A further object of the invention is to provide a combination shower head and scrub brush that has an extendable and retractable handle for reaching hard to get body parts as well as other non human surfaces such as a bath tub and the like.

Yet another object of the invention is to provide a bracket and adaptor fittings and flexible hose for hanging the combination scrub brush and shower head onto a conventional shower spigot.

Other objects and advantages of the present invention will become apparent from the following descriptions, taken in connection with the accompanying drawings, wherein, by way of illustration and example, an embodiment of the present invention is disclosed.

Combination shower head and scrub brush comprising: a flexible hose and attachment means to fasten to a standard water supply and shower spigot, a hanging bracket secured to said standard shower spigot that releasably secures said combination shower head and brush head assembly, an extendible and retractable handle shaft having a hollow interior portion to accept the flow of water, an enclosed chamber containing pair of water flow director hoses and a liquid soap holding portion. A rotatable paddle wheel located within said enclosed chamber is powered by water emanating from the first said hose. A gear driven brush holding plate is powered by a centrally located gear mounted to the opposite surface of the paddle wheel. A shower head integral to the outer body of said enclosed chamber is connected to said second water hose. A selector valve and associated selector knob directs water into said first hose or said second hose. A liquid soap release valve and associated push button to dispenses soap into a sponge portion secured to the outer body of said enclosure. A reclosable cap is located on the outer surface of said enclosed chamber for the purpose of filling said chamber with liquid soap. A replaceable and removable scrub brush mounted onto the circular brush holding plate is capable of being rotated by said water driven paddle wheel. A plurality of alternate scrub brushes can be attached to said rotating brush holding plate for cleaning surfaces other than the human body.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
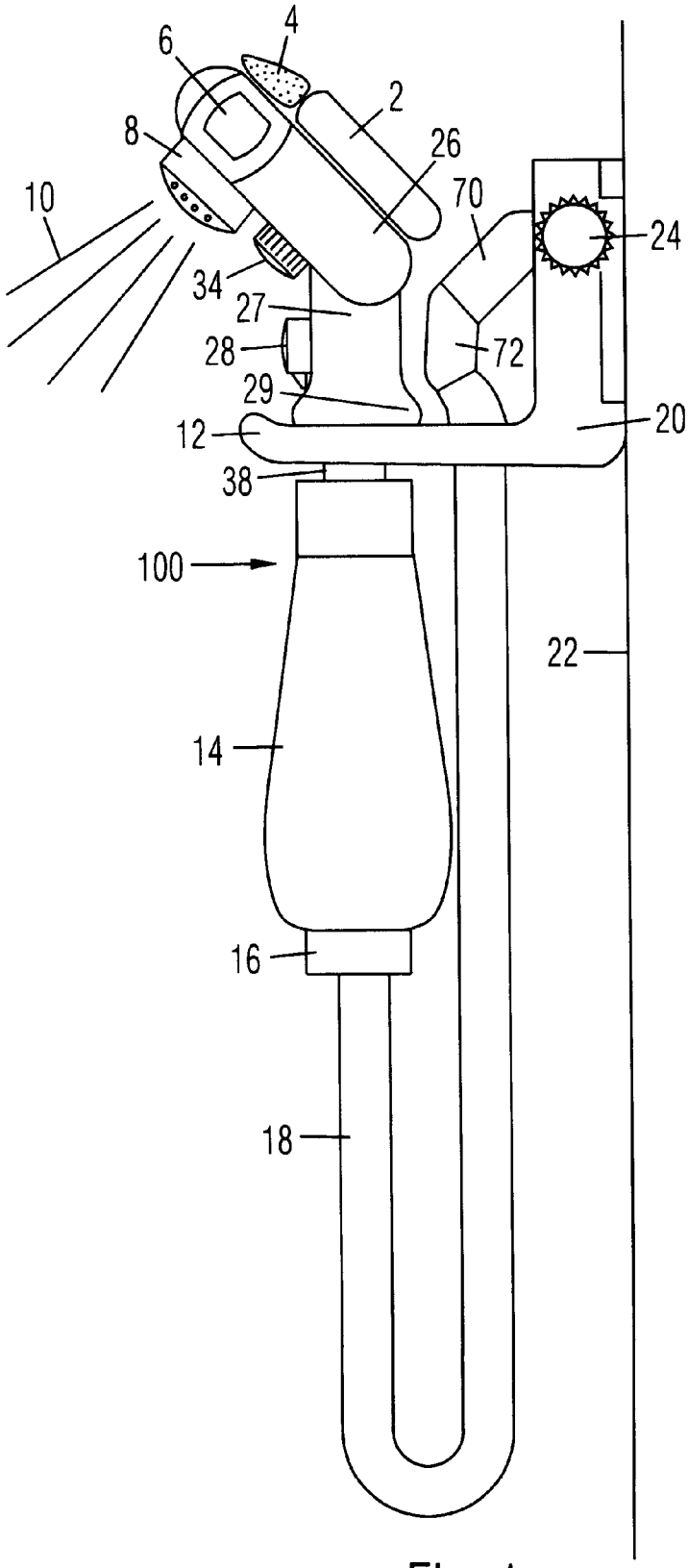
FIG. 1 is a side view of the combination shower head and scrub brush of the present invention

Referring now to FIG. 1 we see a side view of the combination shower head and scrub brush of the present invention 100. Standard shower spigot 70 protrudes from shower stall wall 22. Holding bracket 20 is attached to the spigot 70 by thumb screw 24. Flexible hose 18 is attached at one end to spigot 70 and at the opposite end to handle 14 at fitting 16. The handle 14 and neck 27 and main enclosure 26 are held in place on holding bracket 20 by the flair 29 in neck 27. Main enclosure 26 has a rotatable scrub brush 2 and a liquid soap applicator 4 on one side and a shower head 8 as well as a soap fill cap 34 on the opposite side. The enclosure 26 is angled so that when held in place by bracket 20, the shower water 10 falls in the proper direction for taking a shower. The enclosure 26 is also held at the proper height with relation to spigot 70 so that a persons head can easily fit under the shower head portion 8.

Figure 2:
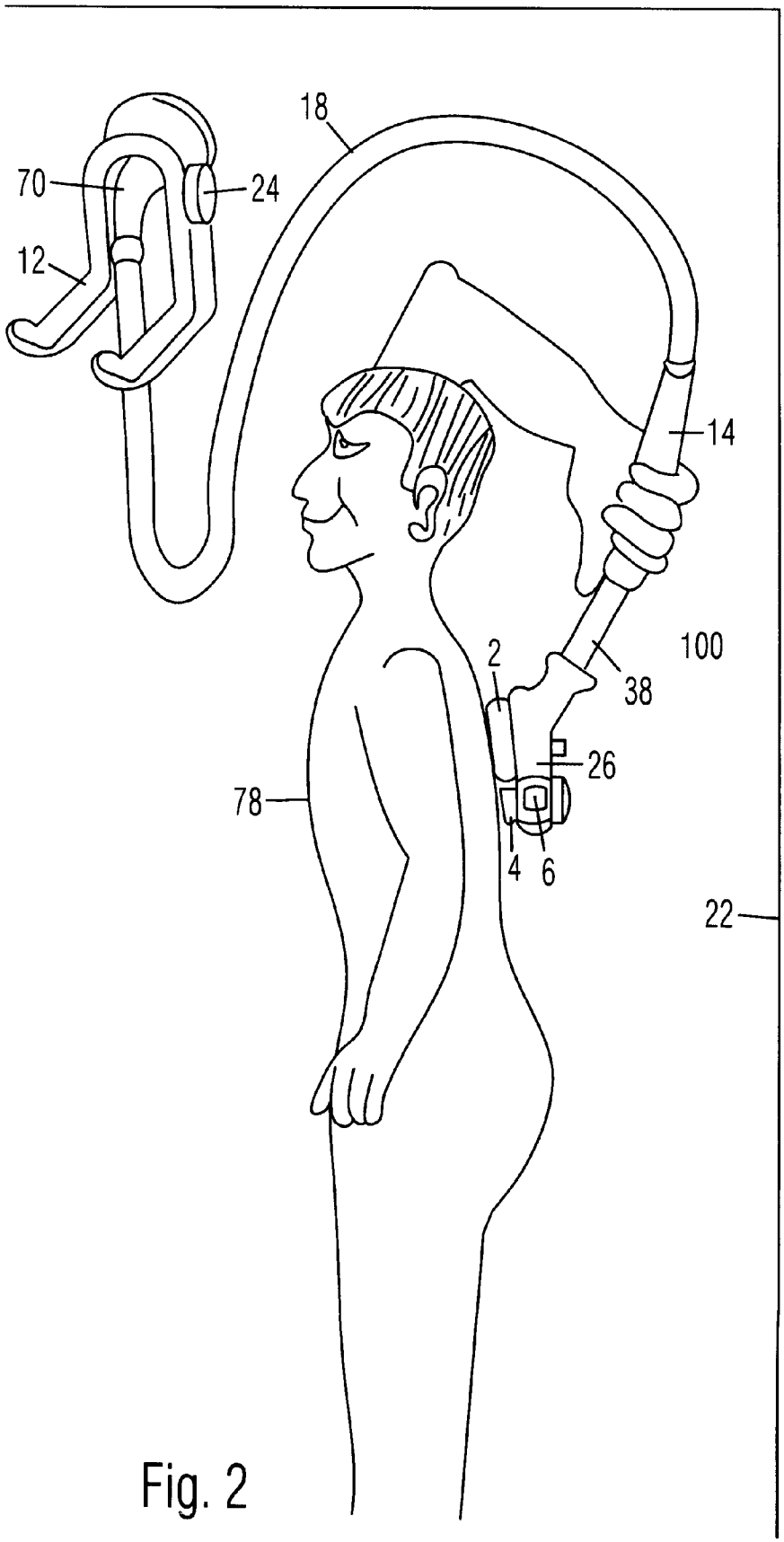
FIG. 2 is a perspective view of a person using the present invention

FIG. 2 shows a person 78 using the present invention 100. Extendible handle 38 is in use to let the user 78 to easily reach his back with scrub brush 2. The angle of enclosure 26 with respect to handle 38, 14 is ideal for a person to scrub his or her back. By pushing button 6 the user can cause liquid soap to impregnate sponge 4 so that can apply soap to his or her body easily. Brush head 2 rotates, as will be explained shortly, so that the user can clean his or her body efficiently without an excess of arm movement.

Figure 3:
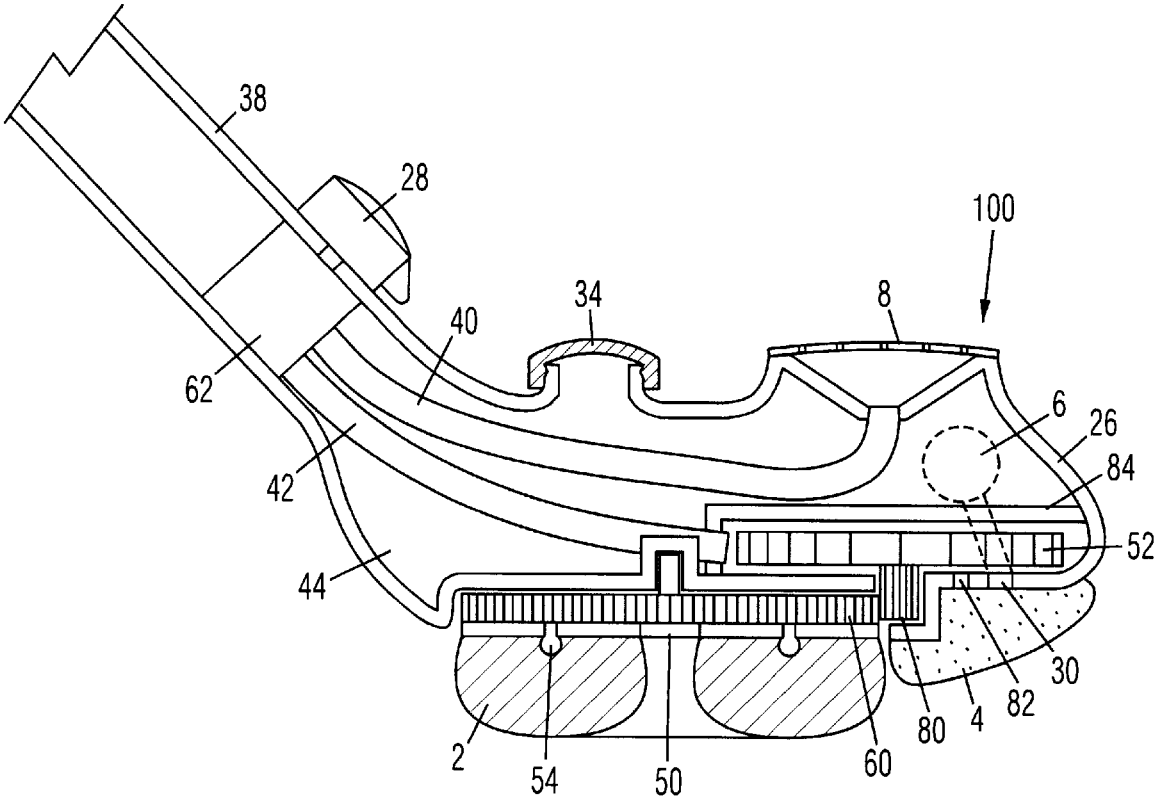
FIG. 3 is a side section view of the present invention

FIG. 3 shows a side section view of the present invention 100. Water flows into hollow handle 38 and through selector valve 62. The user turns selector knob 28 one way for the water to flow through tube 40 to exit the shower head 8 and the opposite way for the water flow through tube 42 to power the paddle wheel 52. Paddle wheel 52 has at is opposite side a centrally located gear 80 that communicates with the gear tooth perimeter of circular plate 60. Plate 60 has a plurality of snap connectors 54 that allow the back plate 50 of scrub brush 2 to be removable and replacably held in place. The action of the pressurized water turning paddle wheel 52 causes scrub brush 2 to rotate. Secondary enclosure 84 encloses the paddle wheel 52 so that the water flow is maximized to the paddles. The remainder of enclosure 26 is hollow and can receive liquid soap that is poured in from opening 34. Push button 6 causes a valve to open allowing the soap through orifice 30 and into sponge 4. In this way a person can apply soap to his or her body easily and efficiently by pushing button 6 and rubbing sponge 4 onto the body surface.

Figure 4:
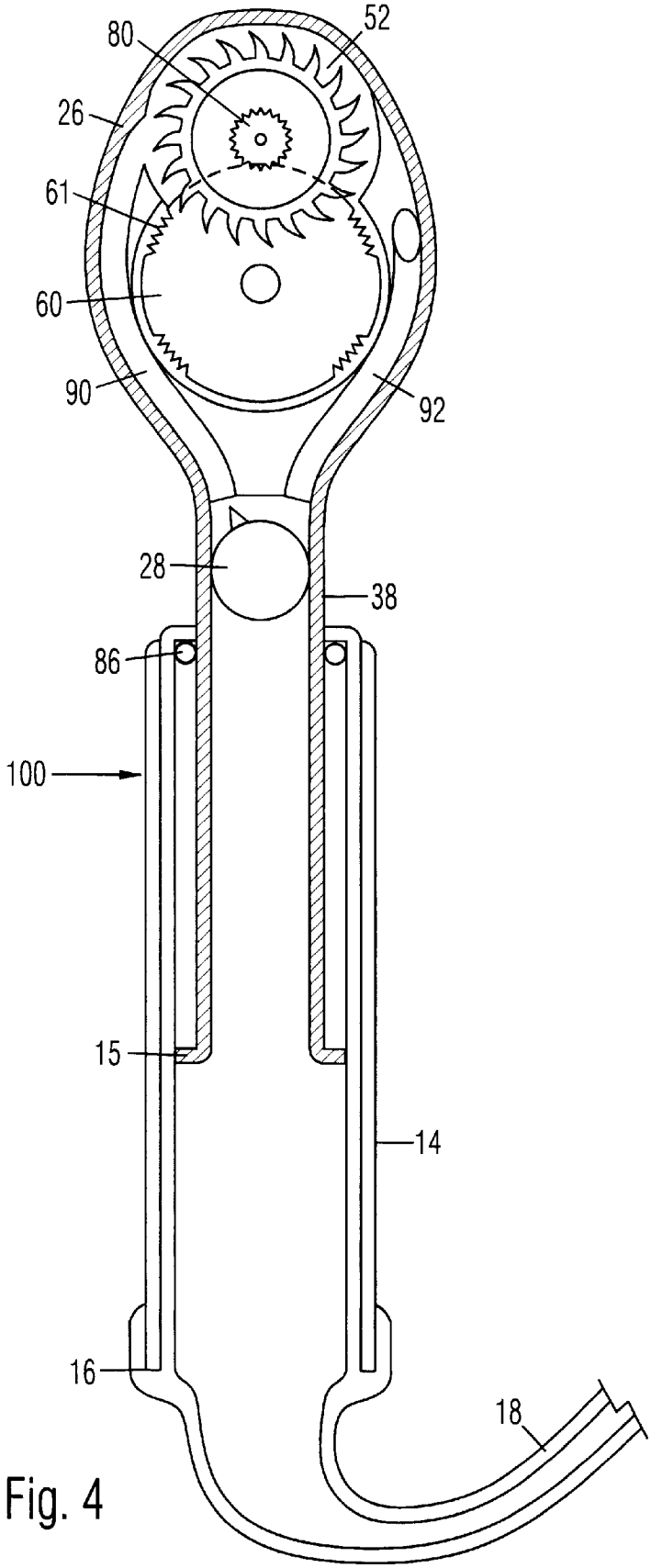
FIG. 4 is a front section view of the present invention

FIG. 4 shows a front section view of the present invention 100. Extendible handle 38 can slide out of handle 14 until stop 15 is reached. O ring 86 keeps water from escaping from handle 14. Water is directed into handle 14 through flexible tube 18 which is coupled to handle 14 by fitting 16. When selector knob 28 is turned to the left, water is directed to paddle wheel 52. Gear 80 located on the opposite side of paddle wheel 52 communicates with gear teeth 61 located on the perimeter of rotating plate 60 causing scrub brush 2 to rotate as explained earlier.

Figure 5:
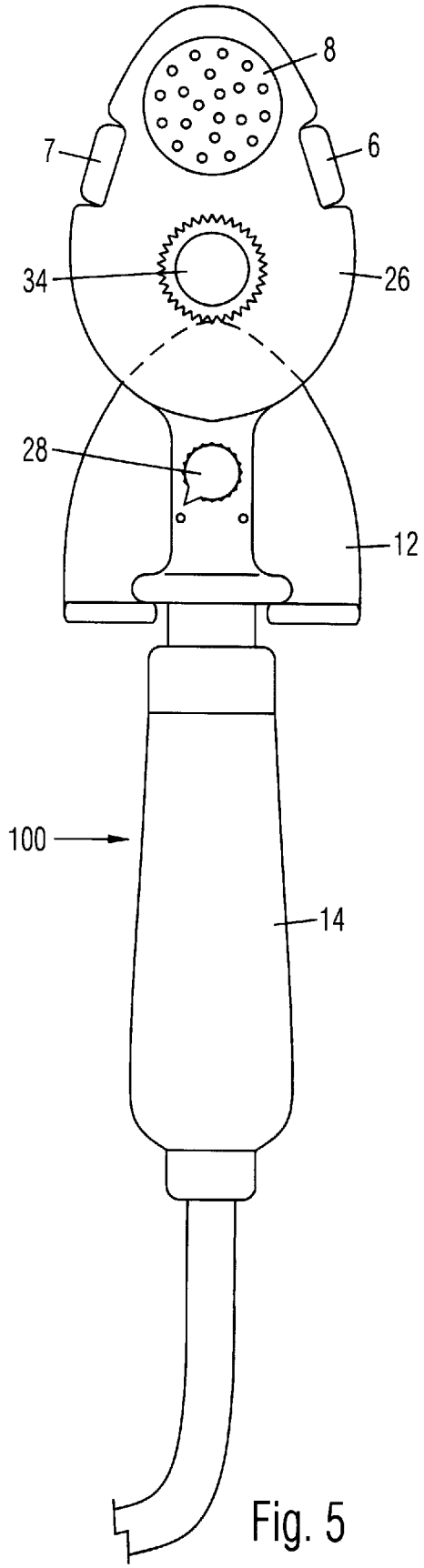
FIG. 5 is a front view of the present invention

FIG. 5 is a front view of the present invention 100. Shower head 8 can be clearly seen. Soap dispensing button 6 is also clearly seen. Button 7 can be ornamental or, alternately, the enclosure 26 can be split in two halves for two different types of soap, one dispensed by button 6 and one dispensed by button 7. Soap cover 34 can be clearly seen as well as selector knob 28.

The present invention is a superior way to clean ones self in a shower stall environment. The combination of a shower head, rotating brush head and soap dispensing system built into on easy to use device as described above will certainly be a pleasure and a boon to all who use it.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Combination shower head and scrub brush comprising:

a flexible hose and attachment means to fasten to a standard shower spigot;

a hanging bracket secured to said standard shower spigot that releasably secures said combination shower head and scrub brush;

an extendible and retractable handle shaft having a hollow interior portion to accept the flow of water;

an enclosed chamber having an outer body containing first and second water flow director hoses and a liquid soap holding portion;

a paddle wheel located within said enclosed chamber powered by water from the first said hose;

a shower head integral to the outer body of said enclosed chamber and being connected to said second water hose;

a selector valve and associated selector knob to direct water into said first hose or said second hose;

a liquid soap release valve and associated push button to dispense soap into a sponge portion secured to the outer body of said enclosure;

a reclosable cap located on the outer surface of said enclosed chamber for the purpose of filling said chamber with liquid soap;

a replaceable and removable scrub brush mounted onto a circular plate capable of being rotated by said water driven paddle wheel.

* * * * *